US010717636B2

(12) United States Patent
Addicott

(10) Patent No.: US 10,717,636 B2
(45) Date of Patent: Jul. 21, 2020

(54) FORK-CARRIAGE APPARATUS FOR A LIFT TRUCK AND VALVE ASSEMBLY THEREFOR

(71) Applicant: Lift Technologies, Inc., Westminster, SC (US)

(72) Inventor: Jody Addicott, Easley, SC (US)

(73) Assignee: Lift Technologies, Inc., Westminster, SC (US)

( * ) Notice: Subject to any disclaimer, the term of this patent is extended or adjusted under 35 U.S.C. 154(b) by 0 days.

(21) Appl. No.: 16/002,088

(22) Filed: Jun. 7, 2018

(65) Prior Publication Data

US 2018/0354761 A1 Dec. 13, 2018

Related U.S. Application Data

(60) Provisional application No. 62/516,719, filed on Jun. 8, 2017.

(51) Int. Cl.
*B66F 9/12* (2006.01)
*B66F 9/22* (2006.01)
(Continued)

(52) U.S. Cl.
CPC ..... *B66F 9/12* (2013.01); *B66F 9/125* (2013.01); *B66F 9/143* (2013.01); *B66F 9/146* (2013.01);
(Continued)

(58) Field of Classification Search
CPC ..... B66F 9/125; B66F 9/146; B66F 9/148; B66F 9/143
See application file for complete search history.

(56) References Cited

U.S. PATENT DOCUMENTS 2,541,268 A * 2/1951 Milz ..... B66F 9/125 414/641
3,241,698 A 3/1966 Krett
(Continued)

FOREIGN PATENT DOCUMENTS

DE 2716704 A1 10/1978
DE 8518185 U1 8/1985
(Continued)

OTHER PUBLICATIONS

Class II ISSFP Integral Sideshifting and Fork Positioning Carriages, Lift-Tek, Jul. 10, 2012, from file:///C:/Users/mhageman/Documents/e-Red%20Folder/16002088/ISSFP%20Generic%20R1.pdf. (Year: 2012).*
(Continued)

*Primary Examiner* — Mark C Hageman
(74) *Attorney, Agent, or Firm* — Panitch Schwarze Belisario & Nadel LLP

(57) ABSTRACT

A fork-carriage apparatus for a lift truck includes: (a) a mounting frame assembly mountable to the lift truck for vertical movement; (b) a side shifter frame assembly slidably mounted to the mounting frame assembly; (c) a pivot frame assembly pivotably mounted to the side shifter frame assembly for translating therewith; (d) a fork assembly mounted to the pivot frame assembly for pivoting therewith; and (e) at least one load-pulling connector mounted to the pivot frame assembly and configured to connect a load to the fork-carriage apparatus for pulling the load.

6 Claims, 8 Drawing Sheets

(51) Int. Cl.
*B66F 9/14* (2006.01)
*B66F 9/16* (2006.01)

(52) U.S. Cl.
CPC ..... *B66F 9/148* (2013.01); *B66F 9/16* (2013.01); *B66F 9/22* (2013.01)

(56) References Cited

U.S. PATENT DOCUMENTS

| | | | | | |
|---|---|---|---|---|---|
| 3,482,722 | A * | 12/1969 | Simovich | B66F 9/125 414/641 |
| 3,734,327 | A | 5/1973 | Ellis, Jr. | |
| 3,782,249 | A | 1/1974 | Drone | |
| 4,095,714 | A * | 6/1978 | Schuster | B66F 9/125 414/607 |
| 4,125,199 | A | 11/1978 | Abels et al. | |
| 4,165,008 | A | 8/1979 | Faust et al. | |
| 4,392,772 | A | 7/1983 | Reeves | |
| 4,505,635 | A | 3/1985 | Shinoda et al. | |
| 5,033,934 | A | 7/1991 | Emilio | |
| 5,096,363 | A | 3/1992 | Weinert et al. | |
| 5,139,385 | A * | 8/1992 | Chase | B66F 9/144 414/667 |
| 5,190,436 | A * | 3/1993 | Sorlie | B66F 9/144 414/667 |
| 5,338,148 | A | 8/1994 | Ronnblom | |
| 5,368,435 | A | 11/1994 | Bostad et al. | |
| 5,374,156 | A | 12/1994 | Simpson et al. | |
| 5,692,874 | A | 12/1997 | Cordani et al. | |
| 5,707,201 | A | 1/1998 | Hamlik | |
| 5,807,060 | A | 9/1998 | Hamlik | |
| 5,820,270 | A | 10/1998 | Richardson | |
| 5,913,654 | A | 6/1999 | Kaup | |
| 6,279,686 | B1 * | 8/2001 | Kaup | B66F 9/143 187/227 |
| 6,308,612 | B1 * | 10/2001 | Emanie | B66F 9/22 414/708 |
| 6,390,763 | B1 | 5/2002 | Prentice | |
| 6,782,910 | B2 | 8/2004 | Mondani et al. | |
| 9,290,366 | B2 * | 3/2016 | Jones, Jr. | B66F 9/22 |
| 9,617,132 | B2 * | 4/2017 | Iotti | B66F 9/143 |
| 2002/0007946 | A1 | 1/2002 | Purkis et al. | |
| 2003/0156935 | A1 | 8/2003 | Mondani et al. | |
| 2003/0164189 | A1 | 9/2003 | Mondani et al. | |
| 2017/0074297 | A1 * | 3/2017 | Olson | B66F 9/22 |
| 2017/0240397 | A1 * | 8/2017 | Eaglestone | B66F 9/24 |
| 2018/0079634 | A1 * | 3/2018 | Petronek | B66F 9/22 |

FOREIGN PATENT DOCUMENTS

| | | | |
|---|---|---|---|
| DE | 19602055 | C1 | 4/1997 |
| DE | 19602553 | A1 | 7/1997 |
| DE | 19805790 | A1 | 8/1998 |
| DE | 20020292 | U1 | 4/2001 |
| EP | 644336 | A1 | 3/1995 |
| EP | 1160191 | A2 | 12/2001 |
| FR | 843328 | A | 6/1939 |
| FR | 2306931 | A1 | 11/1976 |
| FR | 2720123 | A1 | 11/1995 |
| GB | 964161 | A | 7/1964 |
| NL | 7203122 | A | 9/1973 |
| WO | 2014162323 | A1 | 10/2014 |

OTHER PUBLICATIONS

European Search Report dated Oct. 15, 2018 in EP Application No. 18176509.

International Search Report dated May 19, 2003 in International Application No. PCT/CA2003/00212.

Printout of Internet page with YouTube link to a video (published Oct. 7, 2015) showing a demo of the RT022: https://www.youtube.com/watch?v=kYynw7sQw7E, 1 page.

* cited by examiner

FORK-CARRIAGE APPARATUS FOR A LIFT TRUCK AND VALVE ASSEMBLY THEREFOR

CROSS-REFERENCE TO RELATED APPLICATIONS

This application claims the benefit of U.S. Provisional Application No. 62/516,719, entitled "FORK-CARRIAGE APPARATUS FOR A LIFT TRUCK AND VALVE ASSEMBLY THEREFOR", filed Jun. 8, 2017, which is incorporated herein by reference in its entirety.

FIELD

The specification relates to lift trucks, and more specifically, to fork-carriage apparatuses for lift trucks and valve assemblies therefor.

INTRODUCTION

Lift trucks are vehicles used to pick up and move loads from place to place. A conventional lift truck includes a fork-carriage which supports a pair of spaced apart forks. The fork-carriage is movable vertically (e.g. along a mast structure or using a telehandler) for raising and lowering the forks. The forks are maneuvered into place by the lift truck operator and used to pick up a load.

Several attachments to enhance the capabilities of a fork-carriage are known. One such attachment is a side shifter assembly which facilitates aligning the forks with the load. The term "side-shifting" is used to describe the concept of shifting the forks as a spaced pair either left or right of the lift truck center line along a generally horizontal lateral axis. Another attachment includes a pivot assembly (sometimes referred to as a "rotate" or "oscillate" assembly) which facilitates pivoting the load. The term "pivoting" is used to describe the concept of pivoting the forks as a spaced pair about a pivot axis that is generally horizontal and perpendicular to the lateral axis. Another attachment includes a fork positioning assembly. The term "fork positioning" is used to describe the concept of changing the relative spacing between the forks to accommodate loads of different width and pick up requirements.

Such attachments often have limited load capacity in view of weight constraints put on the fork-carriage to reduce the moment load (also referred to as "lost load") exerted by the fork-carriage on the lift truck. Furthermore, while fork-carriages including such attachments are operable to raise and lower loads placed atop the forks, such fork-carriages lack built-in provisions for pulling (e.g. suspending and/or towing) the loads. Furthermore, such attachments are often operated by hydraulic operators (e.g. double-acting cylinders). Operation of these hydraulic operators is dependent on actuation of valves for providing hydraulic fluid to the operators, as well as the transmission of actuation signals through electrical lines for actuating the valves, and damage to the electrical lines can result in inoperability of the hydraulic operators.

SUMMARY

The following summary is intended to introduce the reader to various aspects of the applicant's teaching, but not to define any invention.

According to some aspects, a fork-carriage apparatus for a lift truck is configured for pulling a load. The fork-carriage apparatus includes: (a) a mounting frame assembly mountable to the lift truck for vertical movement; (b) a side shifter frame assembly slidably mounted to the mounting frame assembly, the side shifter frame assembly laterally translatable along a lateral axis fixed relative to the mounting frame assembly; (c) a pivot frame assembly pivotably mounted to the side shifter frame assembly for translating therewith, the pivot frame assembly pivotable about a pivot axis extending perpendicular to the lateral axis, the pivot axis fixed to translate with the side shifter frame assembly; (d) a fork assembly mounted to the pivot frame assembly for pivoting therewith, the fork assembly including a pair of forks projecting from the pivot frame assembly parallel to the pivot axis; and (e) at least one load-pulling connector mounted to the pivot frame assembly and configured to connect the load to the fork-carriage apparatus for pulling the load.

In some examples, the at least one load-pulling connector includes a lifting bracket configured to connect the load to the fork-carriage apparatus for suspending the load.

In some examples, the lifting bracket is configured for connection of a sling hook.

In some examples, the pivot frame assembly includes a lower cross member, an upper cross member above the lower cross member, and a pair of spaced apart first and second side members connecting the upper and lower cross members. The lifting bracket is fixed to an underside surface of the lower cross member.

In some examples, the lifting bracket is welded to the underside surface.

In some examples, the lifting bracket is centered along a length of the lower cross member.

In some examples, the at least one load-pulling connector includes a first hook configured to connect the load to the fork-carriage apparatus for towing the load.

In some examples, the pivot frame assembly includes a lower cross member, an upper cross member above the lower cross member, and a pair of spaced apart first and second side members connecting the upper and lower cross members. Each side member has an inboard surface facing the other side member, and the first hook is fixed to the inboard surface of the first side member.

In some examples, the first hook is welded to the inboard surface of the first side member.

In some examples, the first hook is mounted proximate the lower cross member.

In some examples, the at least one load-pulling connector includes a second hook fixed to the inboard surface of the second side member.

According to some aspects, a pivot frame assembly is pivotably mountable in a fork-carriage apparatus for pivoting a fork assembly about a horizontal pivot axis. The pivot frame assembly includes (a) a lower cross member located below and extending perpendicular to the pivot axis; (b) an upper cross member located above and extending perpendicular to the pivot axis; (c) a pair of laterally spaced apart first and second side members connecting the upper and lower cross members, the pivot axis laterally intermediate the first and second side members; (d) a fork assembly mounting shaft supported by the first and second side members, the fork assembly mounting shaft extending along a fork shaft axis located above and perpendicular to the pivot axis; and (e) a reinforced central support member laterally intermediate the first and second side members and connecting the upper and lower cross members. The central support member includes: (i) a base plate fixed atop the lower cross member, (ii) a pivot plate oriented in a pivot plate plane normal to the pivot axis, the pivot plate fixed atop the base plate, (iii) a pivot plate hole extending through the pivot plate along the pivot axis for receiving a pivot shaft of the fork-carriage apparatus for pivotably mounting the pivot frame assembly, (iv) a fork plate oriented in a fork plate plane normal to the fork shaft axis, the fork plate having a fork plate bottom portion fixed to the pivot plate and an opposed fork plate top portion fixed to the upper cross member, (v) a fork plate hole extending through the fork plate top portion along the fork shaft axis, the fork assembly mounting shaft passing through the fork plate hole and supported by the fork plate, and (vi) a pair of laterally spaced apart first and second gussets each having a gusset bottom edge fixed to the base plate, a gusset top edge above the gusset bottom edge and fixed to the fork plate bottom portion, and a gusset side edge extending between the gusset bottom and top edges and fixed to the pivot plate. The pivot axis is laterally intermediate the first and second gussets and vertically intermediate the gusset bottom and top edges.

In some examples, each of the gusset bottom and top edges extends parallel to the pivot axis, and the gusset side edge extends parallel to the pivot plate plane.

In some examples, the pivot plate includes: a laterally extending pivot plate bottom portion fixed to the base plate, and a pivot plate top portion spaced above the pivot plate bottom portion and fixed to the fork plate bottom portion. The pivot plate hole extends through the pivot plate top portion. The pivot plate further includes a pair of laterally spaced apart pivot plate side support portions connecting the pivot plate top and bottom portions; and a pivot plate central support portion laterally intermediate and spaced apart from the pivot plate side support portions and connecting the pivot plate top and bottom portions.

In some examples, the fork plate plane intersects the pivot axis and the pivot plate central support portion.

In some examples, the pivot plate includes a pivot plate front face oriented parallel to the pivot plate plane, and the gusset side edges are fixed to the pivot plate front face.

In some examples, the pivot plate includes a pivot plate rear face axially opposite the pivot plate front face and oriented parallel to the pivot plate plane, and the lower cross member includes a lower cross member rear face oriented parallel to the pivot plate plane. The pivot plate rear face is generally flush with the lower cross member rear face.

In some examples, the fork plate bottom portion has a mount portion axially overlapping the pivot plate and fixed thereto, and an overhang portion projecting axially forward of the pivot plate front face. Each gusset top edge is fixed to the overhang portion.

In some examples, the overhang portion has laterally opposite side faces each oriented parallel to the fork plate plane, and each gusset top edge is fixed to a respective one of the side faces.

In some examples, the base plate has a pivot plate support portion atop which the pivot plate is fixed, and a gusset support portion axially forward of the pivot plate front face and atop which each gusset bottom edge is fixed.

In some examples, the fork shaft axis is spaced axially forward of the pivot plate front face by a fork shaft spacing. Each gusset top edge extends between a top edge first end axially adjacent the pivot plate front face and a top edge second end spaced axially forward of the pivot plate front face by a top edge second end spacing. The top edge second end spacing is greater than the fork shaft spacing.

In some examples, each gusset bottom edge extends between a bottom edge first end axially adjacent the pivot plate front face and a bottom edge second end spaced axially forward of the pivot plate front face by a bottom edge second end spacing, and wherein the top edge second end spacing is greater than the bottom edge second end spacing.

According to some aspects, a fork-carriage apparatus for a lift truck includes: a frame assembly mountable to the lift truck; a fork assembly supported by the frame assembly; a hydraulic first operator coupled to the frame assembly for urging a first movement of the fork assembly; a hydraulic second operator supported by the frame assembly for urging a second movement of the fork assembly; and a valve assembly coupled to the frame assembly for selectively delivering hydraulic fluid from a hydraulic fluid supply to one of at least the hydraulic first operator and the hydraulic second operator. The valve assembly includes: (a) a manifold having (i) a first supply port for fluid communication with the supply; (ii) a second supply port for fluid communication with the supply; (iii) a first operator port in fluid communication with the first operator; (iv) a second operator port in fluid communication with the first operator; (v) a third operator port in fluid communication with the second operator; (vi) a fourth operator port in fluid communication with the second operator; (vii) a first chamber in fluid communication with the first supply port, the second supply port, the first operator port, and the second operator port; and (viii) a second chamber in fluid communication with the first supply port, the second supply port, the third operator port, and the fourth operator port. The valve assembly further includes (b) an electronic first valve positioned within the first chamber and biased in a first default position. The first valve is movable into a first energized position when receiving a first actuation signal and urged back into the first default position in absence of the first actuation signal. The first valve permits fluid communication between the first and second supply ports and the first and second operator ports, respectively, when in the first default position for conducting fluid to and from the hydraulic first operator. The first valve blocks fluid communication between the first and second supply ports and the first and second operator ports, respectively, when in the first energized position. The valve assembly further includes: (c) an electronic second valve positioned within the second chamber and biased in a second default position. The second valve is movable into a second energized position when receiving a second actuation signal and urged back into the second default position in absence of the second actuation signal. The second valve permits fluid communication between the first and second supply ports and the third and fourth operator ports, respectively, when in the second energized position for conducting fluid to and from the hydraulic second operator. The second valve blocks fluid communication between the first and second supply ports and the third and fourth operator ports, respectively, when in the second default position.

In some examples, the first and second valves are interchangeable for positioning the first valve in the second chamber and the second valve in the first chamber.

In some examples, each of the first operator and the second operator comprises a different one of a side shifter operator for urging lateral translation of the fork assembly, a pivot operator for urging pivoting of the fork assembly, and a fork positioning operator for urging translation of a pair of forks of the fork assembly toward and away from one another.

In some examples, the first operator comprises the side shifter operator.

In some examples, the valve assembly further includes a hydraulic third operator supported by the frame assembly for urging a third movement of the fork assembly, and the valve assembly is further operable to selectively deliver hydraulic fluid from the supply to the hydraulic third operator. The manifold further includes: a fifth operator port in fluid communication with the third operator, a sixth operator port in fluid communication with the third operator, and a third chamber in fluid communication with the first supply port, the second supply port, the fifth operator port, and the sixth operator port. The valve assembly further includes an electronic third valve positioned within the third chamber and biased in a third default position. The third valve is movable into a third energized position when receiving a third actuation signal and urged back into the third default position in absence of the third actuation signal. The third valve permits fluid communication between the first and second supply ports and the fifth and sixth operator ports, respectively, when in the third energized position for conducting fluid to and from the third operator. The third valve blocks fluid communication between the first and second supply ports and the fifth and sixth operator ports, respectively, when in the third default position.

In some examples, each of the first operator, the second operator, and the third operator comprises a different one of a side shifter operator for urging lateral translation of a fork assembly of the fork-carriage apparatus, a pivot operator for urging pivoting of the fork assembly, and a fork positioning operator for urging translation of a pair of forks of the fork assembly toward and away from one another. In some examples, the first operator comprises the side shifter operator.

In some examples, the frame assembly includes: a mounting frame assembly mountable to the lift truck for vertical movement; a side shifter frame assembly slidably mounted to the mounting frame assembly, the side shifter frame assembly laterally translatable along a lateral axis fixed relative to the mounting frame assembly via the hydraulic first operator; and a pivot frame assembly pivotably mounted to the side shifter frame assembly for translating therewith, the pivot frame assembly pivotable about a pivot axis extending perpendicular to the lateral axis via the hydraulic second operator, the pivot axis fixed to translate with the side shifter frame assembly; wherein the fork assembly is mounted to the pivot frame assembly for pivoting therewith, the fork assembly including a pair of forks projecting from the pivot frame assembly parallel to the pivot axis, the forks translatable toward and away from one another via the hydraulic third operator.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 2:
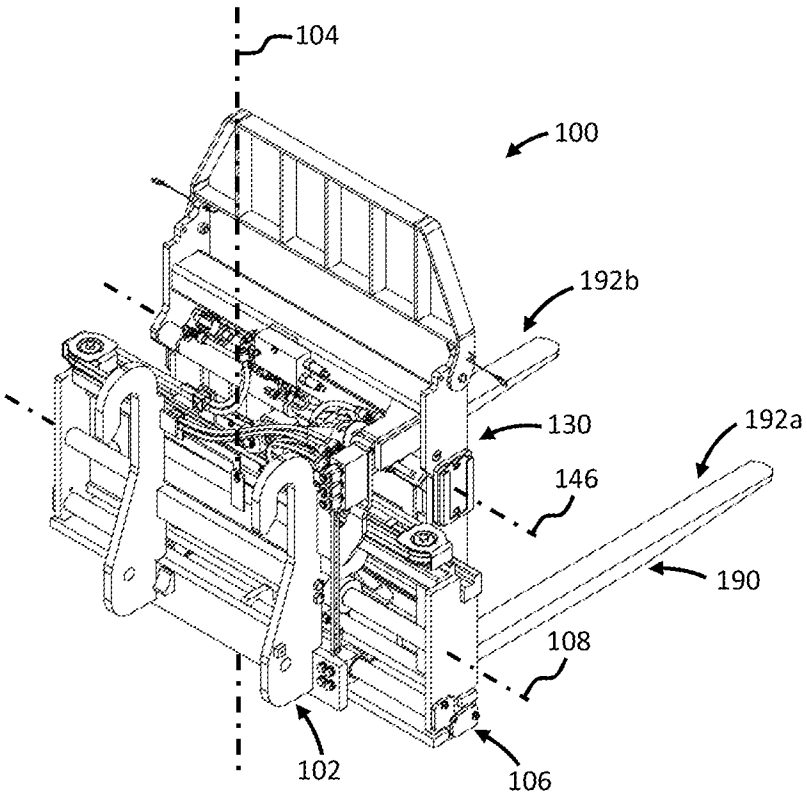
FIG. 2 is a rear perspective view of the fork-carriage apparatus of FIG. 1.
Figure 1:
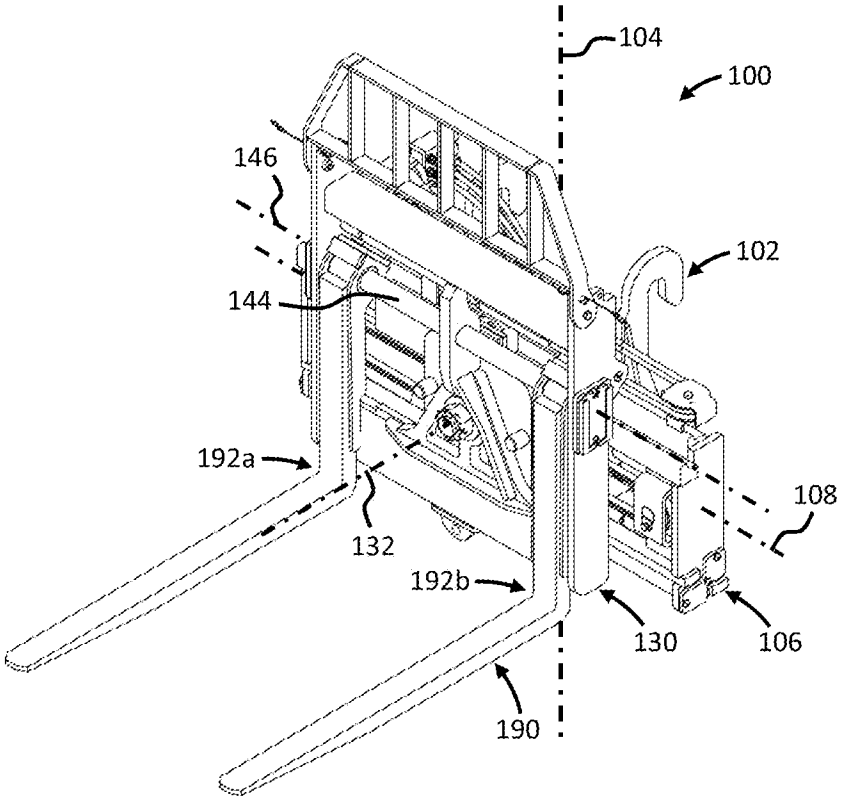
FIG. 1 is a front perspective view of a fork-carriage apparatus for a lift truck.

Referring to FIGS. 1 and 2, in the example illustrated, a fork-carriage apparatus 100 for a lift truck is shown. The fork-carriage apparatus 100 includes a mounting frame assembly 102 mountable to the lift truck for vertical movement (e.g. movement in a vertical direction 104). In some examples, the lift truck can include a mast structure along which the mounting frame assembly 102 is vertically movable. In some examples, the lift truck can include a telehandler for vertically moving the mounting frame assembly 102.

In the example illustrated, the fork-carriage apparatus 100 further includes a side shifter frame assembly 106 slidably mounted to the mounting frame assembly 102. The side shifter frame assembly 106 is laterally translatable along a lateral axis 108 fixed relative to the mounting frame assembly 102. In the example illustrated, the lateral axis 108 is shown as being generally horizontal (i.e. perpendicular to the vertical direction 104).

Figure 3:
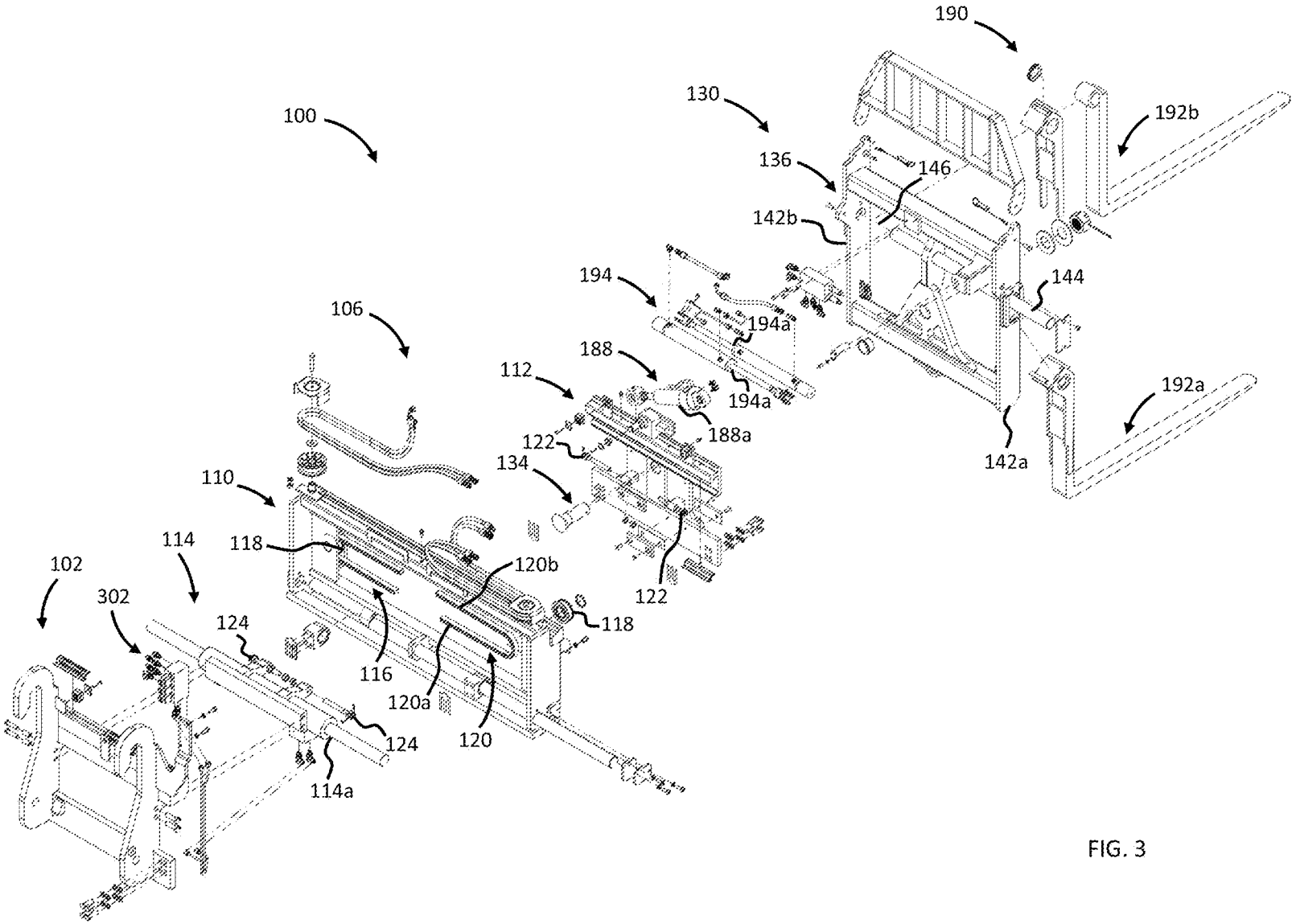
FIG. 3 is an exploded perspective view of the fork-carriage apparatus of FIG. 1.

Referring to FIG. 3, in the example illustrated, the side shifter frame assembly 106 includes a side shifter rear frame 110 slidably mounted to the mounting frame assembly 102 for translating along the lateral axis 108 (see FIGS. 1 and 2) relative to the mounting frame assembly 102. The side shifter frame assembly 106 further includes a side shifter front frame 112 slidably mounted to the rear frame 110 for translating parallel to the lateral axis 108 relative to the rear frame 110. In the example illustrated, translation of the front frame 112 relative to the rear frame 110 is indexed to translation of the rear frame 110 relative to the mounting frame assembly 102. In the example illustrated, translation of the rear frame 110 relative to the mounting frame assembly 102 in a first lateral direction urges translation of the front frame 112 relative to the rear frame 110 in the first lateral direction. Translation of the rear frame 110 relative to the mounting frame assembly 102 in a second lateral direction opposite the first lateral direction urges translation of the front frame 112 relative to the rear frame 110 in the second lateral direction.

Continuing to refer to FIG. 3, in the example illustrated, the fork-carriage apparatus 100 includes a hydraulic side-shifter operator 114 for urging lateral translation of the side shifter frame assembly 106. In the example illustrated, the side-shifter operator 114 includes a double-acting hydraulic side shifter cylinder 114*a* coupled between the mounting frame assembly 102 and the side shifter frame assembly 106 for urging lateral translation of the side shifter frame assembly 106. In the example illustrated, the side shifter cylinder 114*a* is coupled between the mounting frame assembly 102 and the side shifter rear frame 110.

In the example illustrated, the fork-carriage apparatus 100 includes a front frame actuator 116 for urging lateral translation of the side shifter front frame 112 relative to the side shifter rear frame 110. In the example illustrated, the front frame actuator 116 includes a pair of laterally spaced apart first and second chain rollers 118 mounted to the rear frame 110 and a roller chain 120 looped around and in engagement with the chain rollers 118. The chain 120 includes a chain lower portion 120*a* extending between lower portions of the rollers 118 and a chain upper portion 120*b* extending between upper portions of the rollers 118. The front frame 112 is fixed to the chain lower portion 120*a* (e.g. through a pair of front frame chain anchors 122), and the chain upper portion 120*b* is fixed to the mounting frame assembly 102 (e.g. through a pair of mounting frame chain anchors 124). Translation of the side shifter rear frame 110 (and the chain rollers 118 mounted thereto) relative to the mounting frame assembly 102 in a lateral direction translates the lower chain portion 120*a* (and the front frame 112 fixed thereto) relative to the side shifter rear frame 110 in that lateral direction.

Referring to FIG. 1, in the example illustrated, the fork-carriage apparatus 100 further includes a pivot frame assembly 130 pivotably mounted to the side shifter frame assembly 106. The pivot frame assembly 130 is pivotable about a pivot axis 132 extending perpendicular to the lateral axis 108. In the example illustrated, the pivot axis 132 is shown as being generally horizontal (i.e. perpendicular to the vertical direction 104). The pivot frame assembly 130 (and the pivot axis 132) is fixed to translate with the side shifter frame assembly 106. In the example illustrated, the pivot frame assembly 130 (and the pivot axis 132) is fixed to translate with the side shifter front frame 112.

Referring to FIG. 3, in the example illustrated, a pivot shaft 134 extends along the pivot axis 132. The pivot shaft 134 is mounted to and projects axially forward of the side shifter frame assembly 106. In the example illustrated, the pivot shaft 134 is mounted to the side shifter front frame 112. In the example illustrated, the pivot frame assembly 130 is pivotably mounted on the pivot shaft 134 for pivoting about the pivot axis 132.

Figure 5:
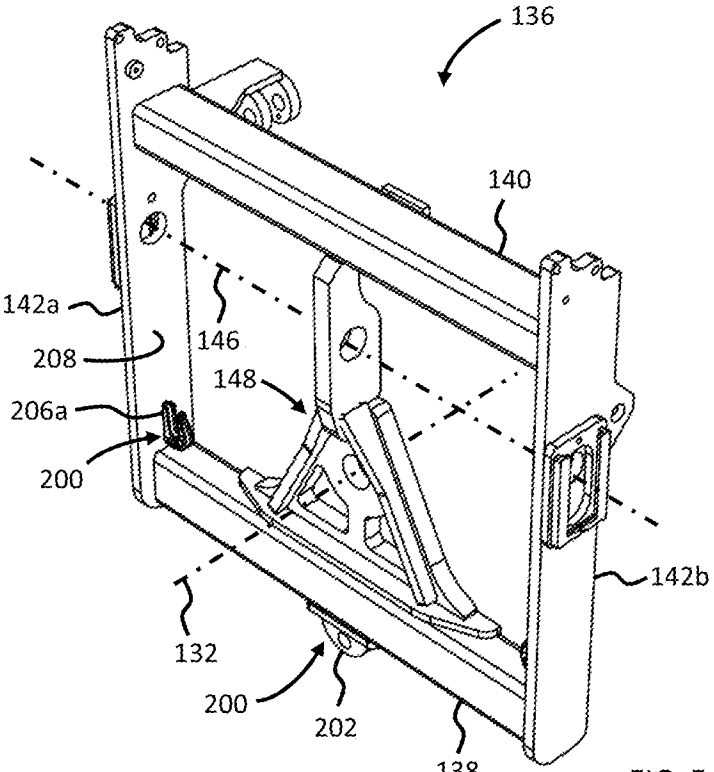
FIG. 5 is a front perspective view of the pivot frame structure of FIG. 4.
Figure 4:
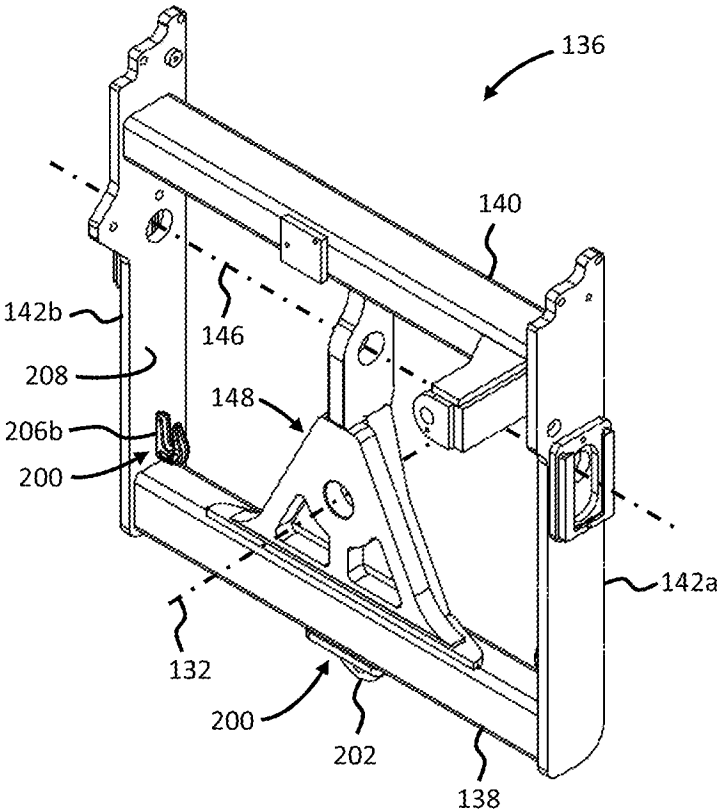
FIG. 4 is a rear perspective view of a pivot frame structure of the fork-carriage apparatus of FIG. 1.

Referring to FIGS. 4 and 5, in the example illustrated, the pivot frame assembly 130 includes a pivot frame 136 having a lower cross member 138 below and extending perpendicular to the pivot axis 132, an upper cross member 140 above and extending perpendicular to the pivot axis 132, and a pair of laterally spaced apart first and second side members 142*a*, 142*b* connecting the lower and upper cross members 138, 140. The pivot axis 132 is laterally intermediate the first and second side members 142*a*, 142*b*.

Referring to FIG. 3, in the example illustrated, the pivot frame assembly 130 further includes a fork assembly mounting shaft 144 extending across the pivot frame 136 and supported by the first and second side members 142*a*, 142*b*. The fork assembly mounting shaft 144 extends along a fork shaft axis 146 located above and extending perpendicular to the pivot axis 132 (see also FIGS. 4 and 5).

Figure 6:
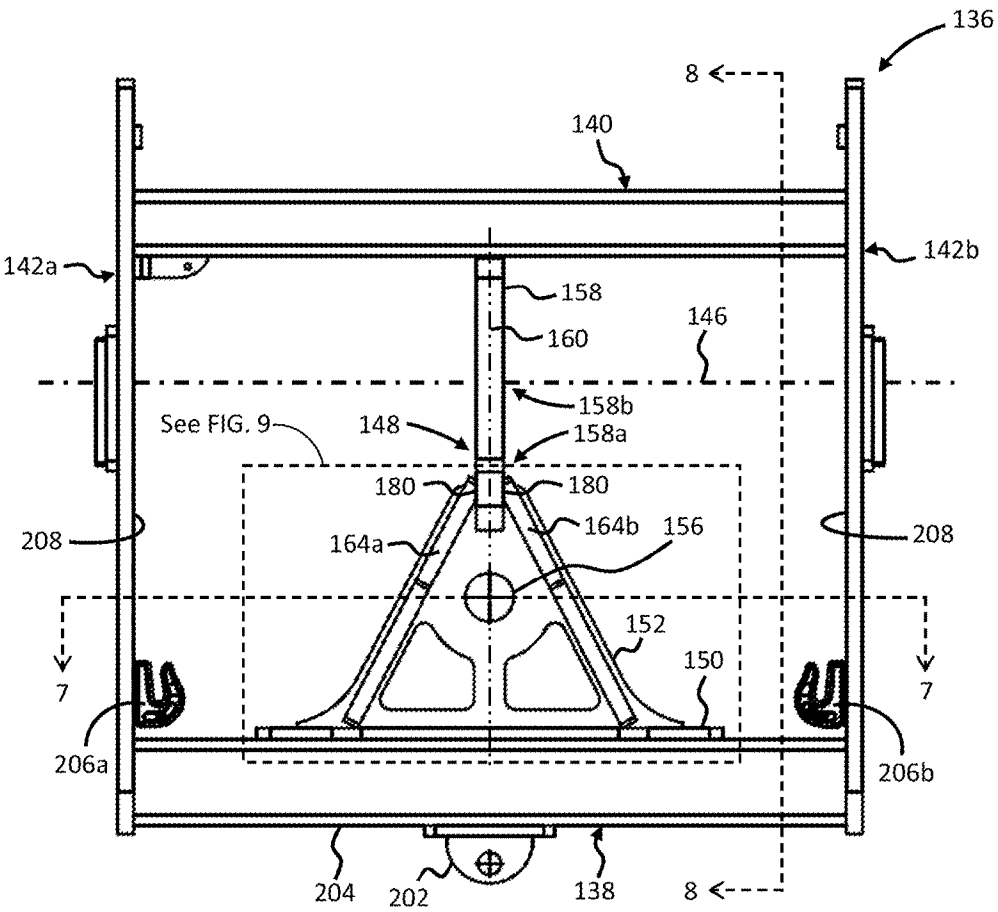
FIG. 6 is a front elevation view of the pivot frame structure of FIG. 4.

Referring to FIGS. 4 and 5, in the example illustrated, the pivot frame 136 further includes a reinforced central support member 148 laterally intermediate the first and second side members 142*a*, 142*b* and connecting the lower and upper cross members 138, 140. Referring to FIG. 6, in the example illustrated, the central support member 148 is laterally centered between the first and second side members 142*a*, 142*b*. The central support member 148 includes a base plate 150 fixed atop the lower cross member 138. The central support member 148 further includes a pivot plate 152 oriented in a pivot plate plane 154 (FIGS. 7 and 8) normal to the pivot axis 132. The pivot plate 152 is fixed atop the base plate 150. A pivot plate hole 156 extends through the pivot plate 152 along the pivot axis 132 for receiving the pivot shaft 134.

Figure 8:
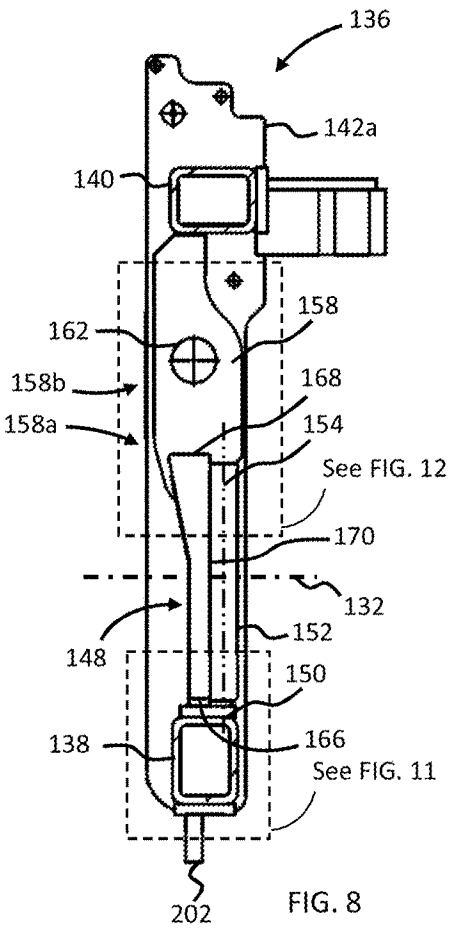
FIG. 8 is a side cross-sectional view of the pivot frame structure of FIG. 4, taken along line 8-8 of FIG. 6.

Referring to FIGS. 6 and 8, in the example illustrated, the central support member 148 further includes a fork plate 158 oriented in a fork plate plane 160 (FIG. 6) normal to the fork shaft axis 146. The fork plate 158 has a fork plate bottom portion 158*a* fixed to the pivot plate 152 and an opposed fork plate top portion 158*b* fixed to the upper cross member 140. Referring to FIG. 8, a fork plate hole 162 extends through the fork plate 158 along the fork shaft axis 146. In the example illustrated, the fork plate hole 162 extends through the fork plate top portion 158*b*. The fork assembly mounting shaft 144 passes through the fork plate hole 162 and is supported by the fork plate 158 (see FIG. 3).

Figure 7:
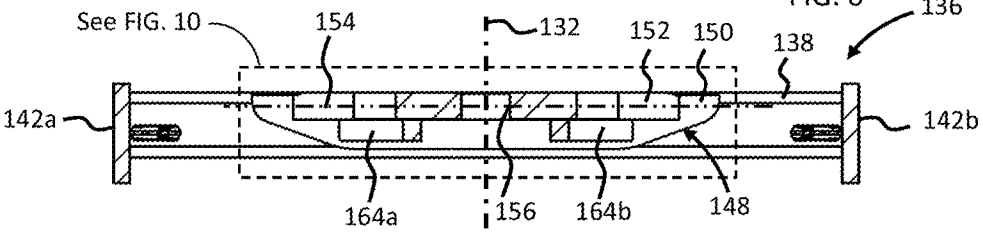
FIG. 7 is a top cross-sectional view of the pivot frame structure of FIG. 4, taken along line 7-7 of FIG. 6.
Figure 9:
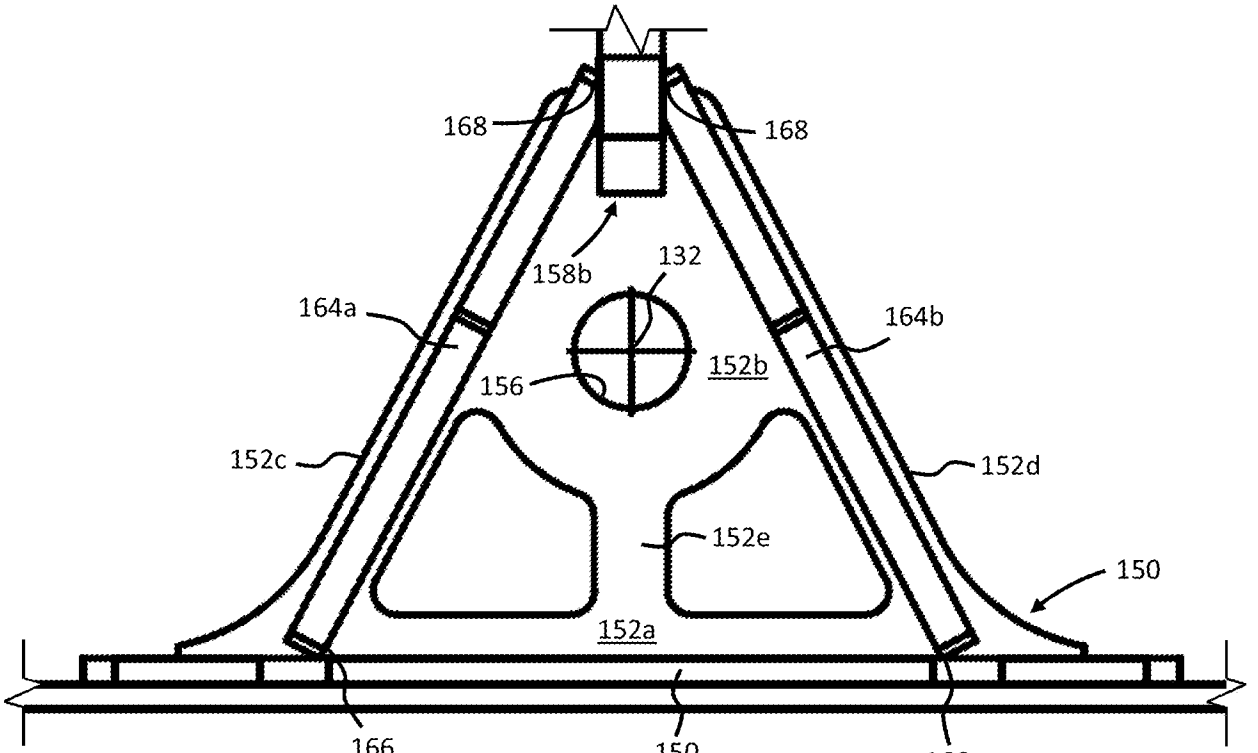
FIG. 9 is an enlarged view of a portion of FIG. 6.
Figure 10:
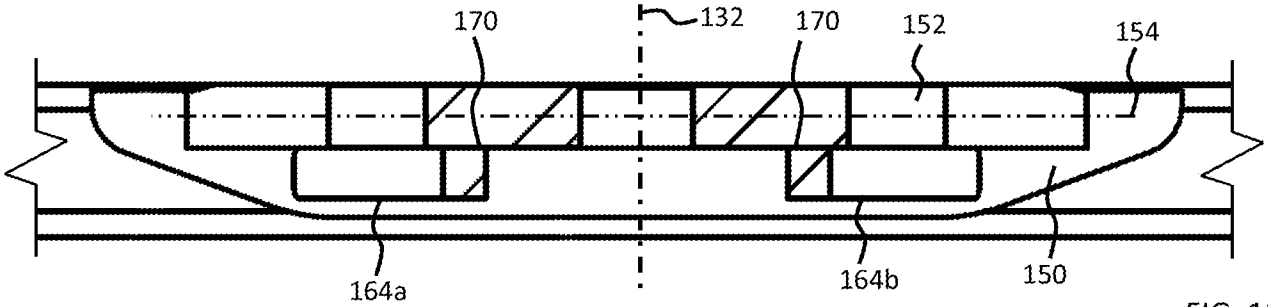
FIG. 10 is an enlarged view of a portion of FIG. 7.

Referring to FIGS. 6 and 7, in the example illustrated, the central support member 148 further includes a pair of laterally spaced apart first and second gussets 164*a*, 164*b*. Referring to FIGS. 9 and 10, each of the first and second gussets 164*a*, 164*b* has a gusset bottom edge 166 (FIG. 9) fixed to the base plate 150, a gusset top edge 168 (FIG. 9) above the gusset bottom edge 166 and fixed to the fork plate bottom portion 158*a*, and a gusset side edge 170 (FIG. 10) extending between the gusset bottom and top edges 166, 168 and fixed to the pivot plate 152. This gusset configuration can help increase the load capacity of the fork-carriage apparatus, without necessarily substantially increasing its weight.

Referring to FIG. 10, in the example illustrated, the pivot axis 132 is laterally intermediate the first and second gussets 164*a*, 164*b*. Referring to FIG. 9, in the example illustrated, the pivot axis 132 is vertically intermediate the gusset bottom and top edges 166, 168. Referring to FIG. 8, in the example illustrated, each of the gusset bottom and top edges 166, 168 extends generally parallel to the pivot axis 132. Each gusset side edge 170 extends parallel to the pivot plate plane 154.

Referring to FIG. 9, in the example illustrated, the pivot plate 152 includes a laterally extending pivot plate bottom portion 152*a* fixed to the base plate 150 and a pivot plate top portion 152*b* spaced above the pivot plate bottom portion 152*a* and fixed to the fork plate bottom portion 158*a*. The pivot plate hole 156 extends through the pivot plate top portion 152*b*. The pivot plate 152 further includes a pair of laterally spaced apart pivot plate side support portions 152*c*, 152*d* connecting the pivot plate bottom and top portions 152*a*, 152*b*, and a pivot plate central support portion 152*e* laterally intermediate and spaced apart from the pivot plate side support portions 152*c*, 152*d* and connecting the pivot plate bottom and top portions 152*a*, 152*b*. Providing the central support portion 152*e* can help increase the load capacity of the fork-carriage apparatus 100, without necessarily substantially increasing its weight. In the example illustrated, the fork plate plane 160 intersects the pivot axis 132 and the pivot plate central support portion 152*e* (see FIG. 6).

Figure 12:
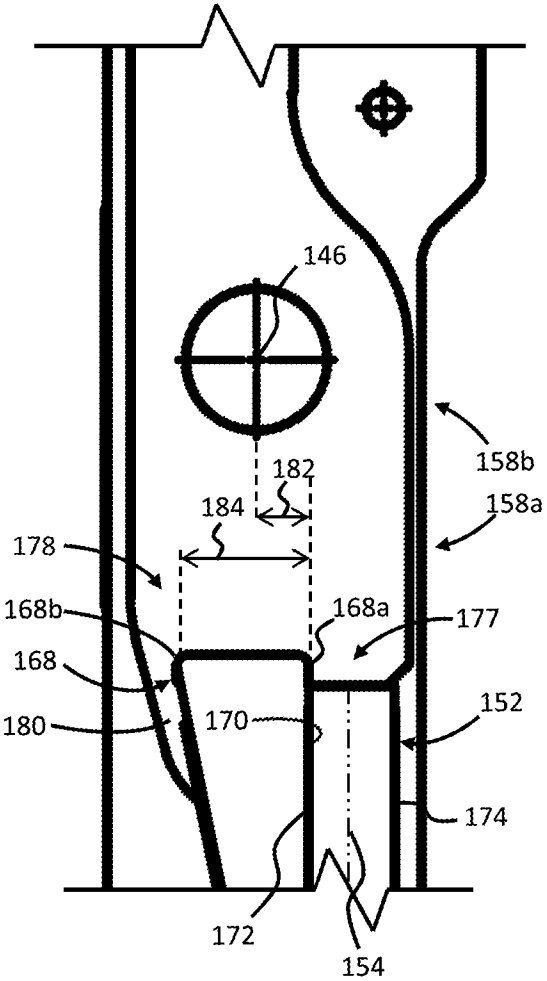
FIG. 12 is an enlarged view of another portion of FIG. 8.
Figure 11:
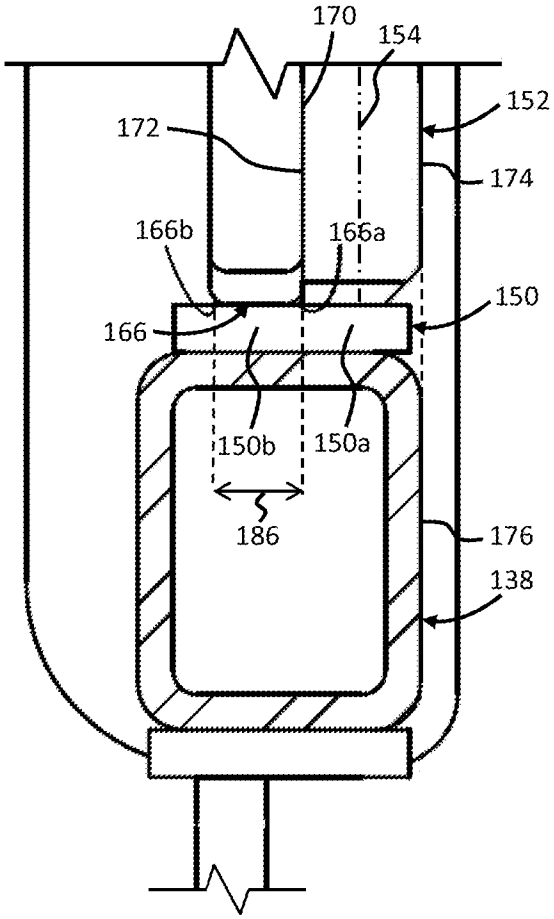
FIG. 11 is an enlarged view of a portion of FIG. 8.

Referring to FIGS. 11 and 12, in the example illustrated, the pivot plate 152 includes a pivot plate front face 172 oriented parallel to the pivot plate plane 154. Each gusset side edge 170 is fixed to the pivot plate front face 172. The pivot plate 152 further includes a pivot plate rear face 174 axially opposite the pivot plate front face 172 and oriented parallel to the pivot plate plane 154. Referring to FIG. 11, in the example illustrated, the lower cross member 138 includes a lower cross member rear face 176 oriented parallel to the pivot plate plane 154. The pivot plate rear face 174 is generally flush with the lower cross member rear face 176.

Referring to FIG. 12, in the example illustrated, the fork plate bottom portion 158*a* has a mount portion 177 axially overlapping the pivot plate 152 and fixed thereto, and an overhang portion 178 projecting axially forward of the pivot plate front face 172. Each gusset top edge 168 is fixed to the overhang portion 178 of the fork plate 158. In the example illustrated, the overhang portion 178 has laterally opposite side faces 180, each oriented parallel to the fork plate plane 160 (see also FIG. 6). Each gusset top edge 168 is fixed to a respective one of the side faces 180.

Referring to FIG. 11, in the example illustrated, the base plate 150 has a pivot plate support portion 150*a* atop which the pivot plate 152 is fixed, and a gusset support portion 150*b* axially forward of the pivot plate front face 172 and atop which each gusset bottom edge 166 is fixed.

Referring to FIG. 12, in the example illustrated, the fork shaft axis 146 is spaced axially forward of the pivot plate front face 172 by a fork shaft spacing 182. Each gusset top edge 168 extends between a top edge first end 168*a* axially adjacent the pivot plate front face 172 and a top edge second end 168*b* spaced axially forward of the pivot plate front face 172 by a top edge second end spacing 184. In the example illustrated, the top edge second end spacing 184 is greater than the fork shaft spacing 182. Referring to FIG. 11, in the example illustrated, each gusset bottom edge 166 extends between a bottom edge first end 166*a* axially adjacent the pivot plate front face 172 and a bottom edge second end 166*b* spaced axially forward of the pivot plate front face 172 by a bottom edge second end spacing 186. In the example illustrated, the top edge second end spacing 184 is greater than the bottom edge second end spacing 186.

Referring to FIG. 3, in the example illustrated, the fork-carriage apparatus 100 includes a hydraulic pivot operator 188 for urging pivoting of the pivot frame assembly 130 about the pivot axis 132. In the example illustrated, the pivot operator 188 comprises a double-acting hydraulic pivot cylinder 188*a* coupled between the side shifter frame assembly 106 and the pivot frame assembly 130 for urging pivoting of the pivot frame assembly 130. In the example illustrated, the pivot cylinder 188*a* is coupled between the side shifter front frame 112 and the pivot frame 136.

Referring to FIGS. 1 and 2, in the example illustrated, the fork-carriage apparatus 100 further includes a fork assembly 190 (see also FIG. 3) mounted to the pivot frame assembly 130. The fork assembly 190 is pivotable about the pivot axis 132 through pivoting of the pivot frame assembly 130, and translatable parallel to the lateral axis 108 through translation of the side shifter frame assembly 106. The fork assembly 190 includes a pair of first and second forks 192*a*, 192*b*. The forks 192*a*, 192*b* have distal ends projecting from the pivot frame assembly 130 parallel to the pivot axis 132. In the example illustrated, each of the forks 192*a*, 192*b* is slidably mounted to the pivot frame assembly 130. In the example illustrated, the first and second forks 192*a*, 192*b* are slidably mounted on the fork assembly mounting shaft 144, and are translatable toward and away from one another parallel to the fork shaft axis 146.

Referring to FIG. 3, in the example illustrated, the fork-carriage apparatus 100 includes a hydraulic fork positioning operator 194 for urging translation of the first and second forks 192*a*, 192*b* toward and away from one another. In the example illustrated, the fork positioning operator 194 includes at least one double-acting hydraulic fork positioning cylinder 194*a* coupled between the pivot frame and at least one of the first and second forks 192*a*, 192*b*. In the example illustrated, the fork positioning operator 194 includes a pair of fork positioning cylinders 194*a*, each coupled between the pivot frame 136 and a respective one of the first and second forks 192*a*, 192*b* for urging translation of the first and second forks 192*a*, 192*b* toward and away from one another.

In the example illustrated, the fork-carriage apparatus 100 has built-in provisions for pulling (e.g. suspending and/or towing) a load. Referring to FIGS. 4 and 5, in the example illustrated, the fork-carriage apparatus 100 includes at least one load-pulling connector 200 mounted to the pivot frame assembly 130 and configured to connect the load to the fork-carriage apparatus 100 for pulling the load. The connector 200 can facilitate connection of the load to the fork-carriage apparatus 100 through, for example, a chain, cable, hook, pintle, and the like.

In the example illustrated, the connector 200 is integrated into the pivot frame 136. In the example illustrated, the connector 200 is welded to the pivot frame 136. Mounting the connecter 200 to a frame structure of the fork-carriage apparatus 100 (such as the pivot frame 136) can help reduce the lost load by moving the load center axially rearward toward the lift truck. Mounting the connector 200 to the pivot frame assembly 130 can facilitate access to the connector 200, and can facilitate pivoting and/or translation of the connector 200 relative to the lift truck.

In the example illustrated, the at least one load-pulling connector 200 includes a lifting bracket 202 configured to connect the load to the fork-carriage apparatus 100 for suspending the load. Referring to FIG. 6, in the example illustrated, the lifting bracket 202 is fixed to an underside surface 204 of the lower cross member 138 of the pivot frame 136. In the example illustrated, the lifting bracket 202 is welded to the underside surface 204. In the example illustrated, the lifting bracket 202 is centered along a length of the lower cross member 138. In the example illustrated, the lifting bracket 202 is configured for connection of a sling hook.

Continuing to refer to FIG. 6, in the example illustrated, the at least one load-pulling connector 200 further includes a first hook 206*a*. In the example illustrated, the first hook 206*a* comprises a tow hook configured to connect the load to the fork-carriage apparatus 100 for towing the load. In the example illustrated, each side member 142*a*, 142*b* of the pivot frame 136 has an inboard surface 208 facing the other side member 142*a*, 142*b*, and the first hook 206*a* is fixed to the inboard surface 208 of the first side member 142*a*. In the example illustrated, the at least one load-pulling connector 200 further includes a second hook 206*b* fixed to the inboard surface 208 of the second side member 142*b*. In the example illustrated, each of the first and second hooks 206*a*, 206*b* are mounted proximate the lower cross member 138. In the example illustrated, each of the first and second hooks 206*a*,

206*b* is welded to a respective inboard surface 208 of the first and second side members 142*a*, 142*b*.

Figure 13:
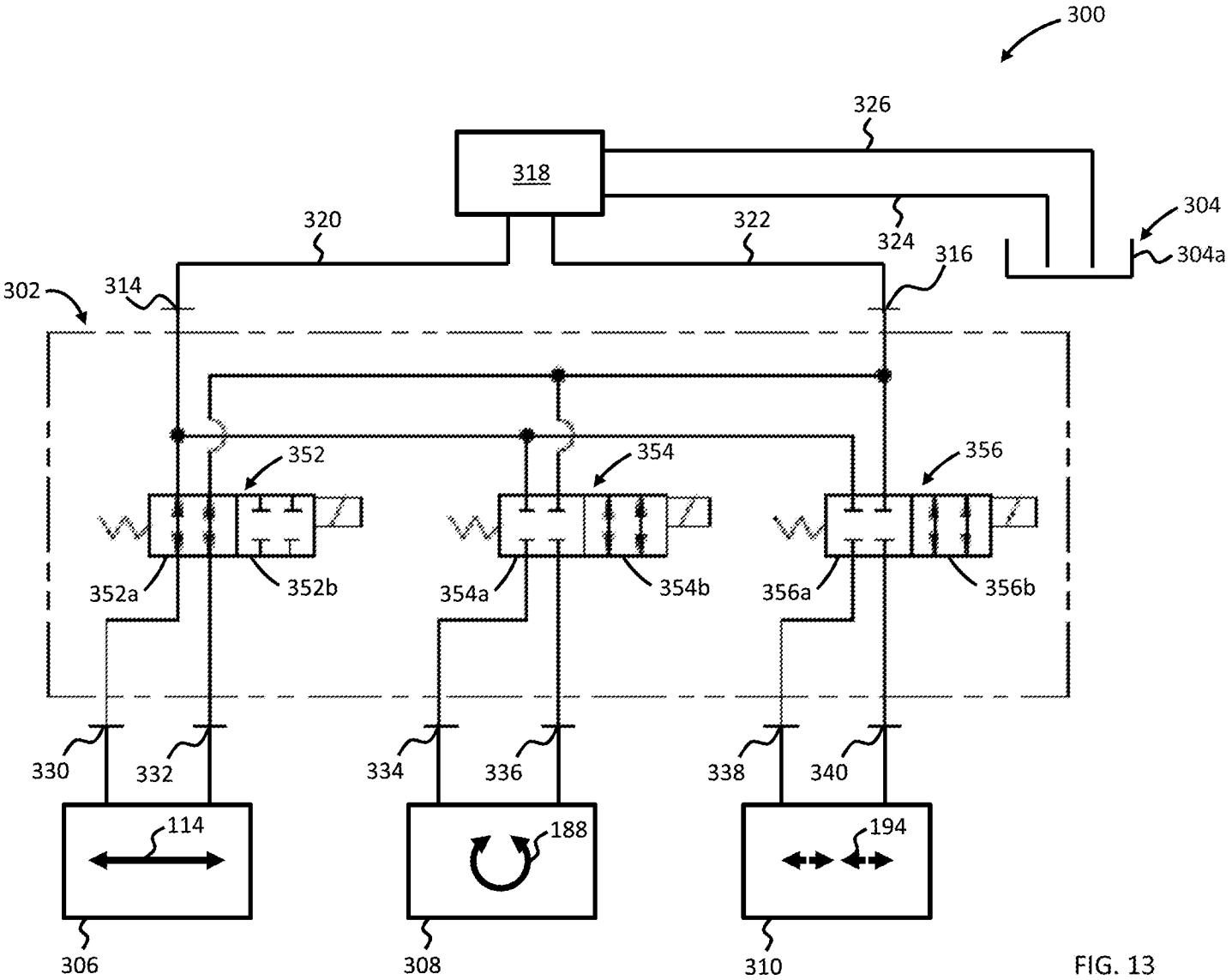
FIG. 13 is a simplified schematic of portions of a hydraulic circuit for the fork-carriage apparatus of FIG. 1.

Referring to FIG. 13, a simplified schematic of a hydraulic circuit 300 for the fork-carriage apparatus 100 is shown. In the example illustrated, the hydraulic circuit 300 includes a valve assembly 302 (see also FIGS. 3 and 14) for selectively delivering hydraulic fluid from a hydraulic fluid supply 304 to one of at least a hydraulic first operator 306 and a hydraulic second operator 308 of the fork-carriage apparatus 100. In the example illustrated, the valve assembly 302 is further operable to selectively deliver hydraulic fluid from the supply 304 to a hydraulic third operator 310.

Each of the first operator 306, second operator 308, and third operator 310 can include a different one of the side shifter operator 114, the pivot operator 188, and the fork positioning operator 194 of the fork-carriage apparatus 100. In the example illustrated, the first operator 306 includes the side shifter operator 114, the second operator 308 includes the pivot operator 188, and the third operator 310 includes the fork positioning operator 194.

Figure 15:
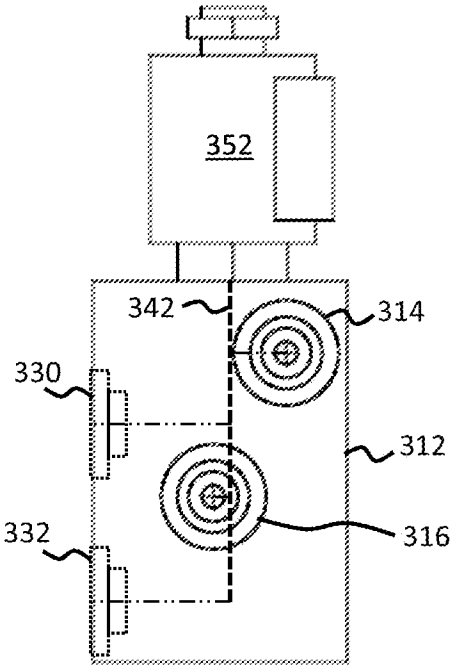
FIG. 15 is a partially schematic, side elevation view of the valve assembly of FIG. 14.
Figure 14:
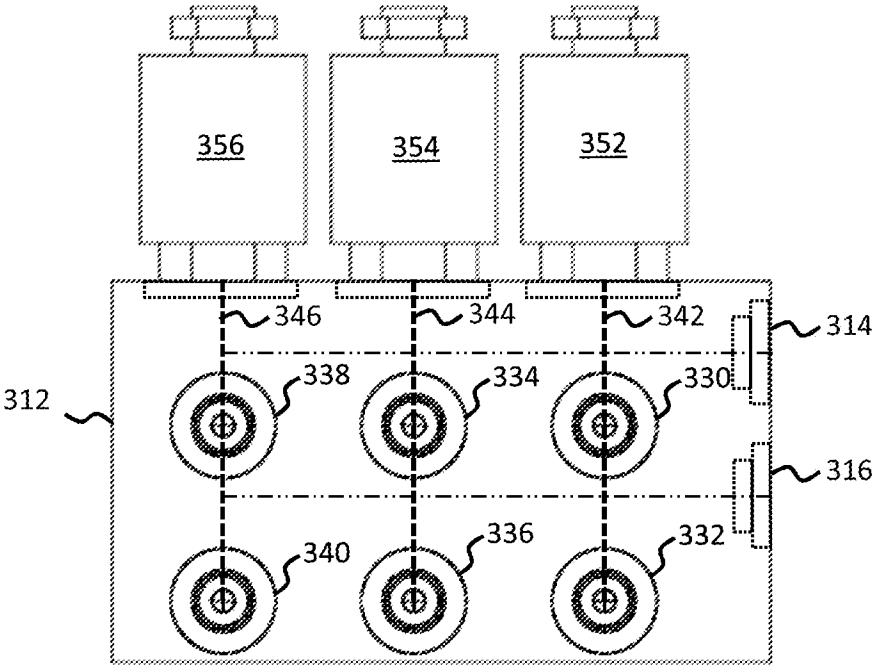
FIG. 14 is a partially schematic, front elevation view of a valve assembly of the circuit of FIG. 13.

Referring to FIGS. 14 and 15, in the example illustrated, the valve assembly 302 includes a manifold 312 having a first supply port 314 for fluid communication with the supply 304 and a second supply port 316 for fluid communication with the supply 304. Referring to FIG. 13, in the example illustrated, the first and second supply ports 314, 316 are in fluid communication with a hydraulic sub-circuit 318 through first and second supply lines 320, 322, respectively. In the example illustrated, the hydraulic fluid supply 304 includes a hydraulic fluid supply tank 304*a*, and the sub-circuit 318 is connected to the supply tank 304*a* through a tank supply line 324 and a tank return line 326. The sub-circuit 318 can include, for example, a hydraulic control panel for interchangeably connecting the tank supply and return lines 324, 326 to the first and second supply lines 320, 322. A pump (not shown) is connected to the tank supply line 324 to provide the hydraulic fluid under pressure.

Referring to FIGS. 14 and 15, in the example illustrated the manifold 312 further includes a first operator port 330 for fluid communication with the first operator 306, a second operator port 332 for fluid communication with the first operator 306, a third operator port 334 for fluid communication with the second operator 308, and a fourth operator port 336 for fluid communication with the second operator 308. In the example illustrated, the manifold 312 further includes a fifth operator port 338 for fluid communication with the third operator 310, and a sixth operator port 340 for fluid communication with the third operator 310.

In the example illustrated, the manifold 312 further includes a first chamber 342 (shown schematically in FIGS. 14 and 15) in fluid communication with the first supply port 314, the second supply port 316, the first operator port 330, and the second operator port 332, and a second chamber 344 (shown schematically in FIG. 14) in fluid communication with the first supply port 314, the second supply port 316, the third operator port 334, and the fourth operator port 336. In the example illustrated, the manifold 312 further includes a third chamber 346 (shown schematically in FIG. 14) in fluid communication with the first supply port 314, the second supply port 316, the fifth operator port 338, and the sixth operator port 340.

Referring to FIG. 14, in the example illustrated, the valve assembly 302 includes an electronic first valve 352 (e.g. a solenoid valve) positioned within the first chamber 342. Referring to FIG. 13, in the example illustrated, the first valve 352 is biased in a first default position 352*a*. The first valve 352 is movable into a first energized position 352*b* when receiving a first actuation signal and urged back into the first default position 352*a* in absence of the first actuation signal. When in the first energized position 352*b*, the first valve 352 is closed and blocks fluid communication between the first and second supply ports 314, 316 and the first and second operator ports 330, 332, respectively. When in the first default position 352*a*, the first valve 352 is open and permits fluid communication between the first and second supply ports 314, 316 and the first and second operator ports 330, 332, respectively.

In the example illustrated, the valve assembly 302 further includes an electronic second valve 354 positioned within the second chamber 344 (FIG. 14). The second valve 354 is biased in a second default position 354*a*. The second valve 354 is movable into a second energized position 354*b* when receiving a second actuation signal and urged back into the second default position 354*a* in absence of the second actuation signal. When in the second energized position 354*b*, the second valve 354 is open and permits fluid communication between the first and second supply ports 314, 316 and the third and fourth operator ports 334, 336. When in the second default position 354*a*, the second valve 354 is closed and blocks fluid communication between the first and second supply ports 314, 316 and the third and fourth operator ports 334, 336, respectively.

In the example illustrated, the valve assembly 302 further includes an electronic third valve 356 positioned within the third chamber 346 (FIG. 14). The third valve 356 is biased in a third default position 356*a*. The third valve 356 is movable into a third energized position 356*b* when receiving a third actuation signal and urged back into the third default position 356*a* in absence of the third actuation signal. When in the third energized position 356*b*, the third valve 356 is open and permits fluid communication between the first and second supply ports 314, 316 and the fifth and sixth operator ports 338, 340, respectively. When in the third default position 356*a*, the third valve 356 is closed and blocks fluid communication between the first and second supply ports 314, 316 and the fifth and sixth operator ports 338, 340, respectively.

To facilitate supply of hydraulic fluid to the third operator 310, the first and third actuation signals are transmitted to the first and third valves 352, 356 (e.g. through electrical lines coupled to the valves) to move the first and third valves 352, 356 into the first and third energized positions (i.e. to close the first valve 352 and open the third valve 356). To facilitate supply of hydraulic fluid to the second operator 308, the first and second actuation signals are transmitted to the first and second valves 352, 354 to move the first and second valves 352, 354 into the first and second energized positions (i.e. to close the first valve 352 and open the second valve 354). To facilitate supply of hydraulic fluid to the first operator 306, none of the first, second, and third actuation signals are transmitted so that the first, second, and third valves 352, 354, 356 are in respective default positions, in which the first valve 352 is open and the second and third valves 354, 356 are closed (as shown in FIG. 13). This valve configuration can facilitate operation of at least the first operator 306 of the fork-carriage apparatus 100 in cases where, for example, the electrical lines for transmitting the valve actuation signals to the first, second, and third valves 352, 354, 356 are damaged or otherwise inoperable.

In the example illustrated, the first, second, and third valves 352, 354, 356 are interchangeable, in that the first valve 352 can be positioned within the second or third chambers 344, 346, the second valve 354 can be positioned within the first or third chambers 342, 346, and the third valve 356 can be positioned within the first or second chambers 342, 344. This can help allow for positioning of the first valve 352 into any one of the first, second, and third chambers 342, 344, 346 to facilitate operation of a corresponding one of the first, second, and third operators 306, 308, 310 independent of the valve actuation signals.

The invention claimed is:

1. A fork-carriage apparatus for a lift truck, comprising:

a frame assembly mountable to the lift truck;

a fork assembly supported by the frame assembly;

a hydraulic first operator coupled to the frame assembly for urging a first movement of the fork assembly;

a hydraulic second operator supported by the frame assembly for urging a second movement of the fork assembly; and a valve assembly coupled to the frame assembly for selectively delivering hydraulic fluid from a hydraulic fluid supply to one of at least the hydraulic first operator and the hydraulic second operator, the valve assembly including:

a) a manifold having:

i) a first supply port for fluid communication with the supply;

ii) a second supply port for fluid communication with the supply;

iii) a first operator port in fluid communication with the first operator;

iv) a second operator port in fluid communication with the first operator;

v) a third operator port in fluid communication with the second operator;

vi) a fourth operator port in fluid communication with the second operator;

vii) a first chamber in fluid communication with the first supply port, the second supply port, the first operator port, and the second operator port; and viii) a second chamber in fluid communication with the first supply port, the second supply port, the third operator port, and the fourth operator port;

b) an electronic first valve positioned within the first chamber and biased in a first default position, the first valve being movable into a first energized position when receiving a first actuation signal and urged back into the first default position in absence of the first actuation signal, wherein the first valve permits fluid communication between the first and second supply ports and the first and second operator ports, respectively, when in the first default position for conducting fluid to and from the hydraulic first operator, and the first valve blocks fluid communication between the first and second supply ports and the first and second operator ports, respectively, when in the first energized position; and c) an electronic second valve positioned within the second chamber and biased in a second default position, the second valve being movable into a second energized position when receiving a second actuation signal and urged back into the second default position in absence of the second actuation signal, wherein the second valve permits fluid communication between the first and second supply ports and the third and fourth operator ports, respectively, when in the second energized position for conducting fluid to and from the hydraulic second operator, and the second valve blocks fluid communication between the first and second supply ports and the third and fourth operator ports, respectively, when in the second default position.

2. The apparatus of claim 1, wherein the first and second valves are interchangeable for positioning the first valve in the second chamber and the second valve in the first chamber.

3. The apparatus of claim 1, further comprising a hydraulic third operator for urging a third movement of the fork assembly, and wherein the valve assembly is further operable to selectively deliver hydraulic fluid from the supply to the hydraulic third operator, wherein the manifold further includes:

a fifth operator port in fluid communication with the third operator, a sixth operator port in fluid communication with the third operator, and a third chamber in fluid communication with the first supply port, the second supply port, the fifth operator port, and the sixth operator port, wherein the valve assembly further includes an electronic third valve positioned within the third chamber and biased in a third default position, the third valve being movable into a third energized position when receiving a third actuation signal and urged back into the third default position in absence of the third actuation signal, and wherein the third valve permits fluid communication between the first and second supply ports and the fifth and sixth operator ports, respectively, when in the third energized position for conducting fluid to and from the third operator, and the third valve blocks fluid communication between the first and second supply ports and the fifth and sixth operator ports, respectively, when in the third default position.

4. The apparatus of claim 3, wherein each of the first operator, the second operator, and the third operator comprises a different one of a side shifter operator for urging lateral translation of a fork assembly of the fork-carriage apparatus, a pivot operator for urging pivoting of the fork assembly, and a fork positioning operator for urging translation of a pair of forks of the fork assembly toward and away from one another.

5. The apparatus of claim 4, wherein the first operator comprises the side shifter operator.

6. The apparatus of claim 3, wherein the frame assembly includes:

a mounting frame assembly mountable to the lift truck for vertical movement;

a side shifter frame assembly slidably mounted to the mounting frame assembly, the side shifter frame assembly laterally translatable along a lateral axis fixed relative to the mounting frame assembly via the hydraulic first operator; and a pivot frame assembly pivotably mounted to the side shifter frame assembly for translating therewith, the pivot frame assembly pivotable about a pivot axis extending perpendicular to the lateral axis via the hydraulic second operator, the pivot axis fixed to translate with the side shifter frame assembly;

wherein the fork assembly is mounted to the pivot frame assembly for pivoting therewith, the fork assembly including a pair of forks projecting from the pivot frame assembly parallel to the pivot axis, the forks translatable toward and away from one another via the hydraulic third operator.

* * * * *